United States Patent [19]

Smith

[11] 4,119,745

[45] Oct. 10, 1978

[54] DEPOSITION OF ELECTROLUMINESCENT MATERIAL THROUGH SUPERIMPOSED DUAL MASKS

[75] Inventor: Peter John Fennemore Smith, Wimborne, England

[73] Assignees: Smiths Industries Limited, London; Phosphor Products Company Limited, Poole, both of England

[21] Appl. No.: 752,941

[22] Filed: Dec. 22, 1976

[30] Foreign Application Priority Data

Dec. 23, 1975 [GB] United Kingdom ..... 52585/75

[51] Int. Cl.[2] ..... B05D 5/06

[52] U.S. Cl. ..... 427/66; 427/64; 427/68; 427/124; 427/266; 427/282; 313/505; 118/504; 118/505; 101/128.2; 101/129; 156/90; 156/247; 29/25.1

[58] Field of Search ..... 427/61, 68, 266, 282, 427/64; 313/505; 29/25.1; 118/504, 505; 101/129, 128.2; 156/90

[56] References Cited

U.S. PATENT DOCUMENTS

| | | | |
|---|---|---|---|
| Re. 29,284 | 6/1977 | Shaheen et al. | 427/282 |
| 2,599,710 | 6/1952 | Hathaway | 427/282 |
| 3,042,834 | 7/1962 | Nicoll | 313/505 |
| 3,258,628 | 6/1966 | Acton | 313/505 |
| 3,304,471 | 2/1967 | Zuleeb | 427/282 |

OTHER PUBLICATIONS

Balents, L. M.; "Metal Mask and Screen Assembly," RCA Technical Notes, No. 979, 9/74.

*Primary Examiner*—John T. Goolkasian
*Attorney, Agent, or Firm*—Pollock, Vande Sande & Priddy

[57] ABSTRACT

A display device includes a layer of electroluminescent material which is capable of conducting electric current. The electroluminescent material is sandwiched between a pair of electrodes to which a voltage is to be applied to excite the electroluminescent material to luminescence. The display device is manufactured by disposing on an assembly comprising a substrate with one of the said electrodes thereon, two masks in which are formed aligned apertures defining a region in which the electroluminescent material is to be provided. The electroluminescent material is disposed in the apertures, and, after that material has solidified one of the masks is removed, the other of the electrodes then being formed on the exposed surface of the electroluminescent material and within slots in the remaining mask and the mask is removed.

8 Claims, 7 Drawing Figures

DEPOSITION OF ELECTROLUMINESCENT MATERIAL THROUGH SUPERIMPOSED DUAL MASKS

This invention relates to display devices, and, more particularly, to display devices comprising a layer of electroluminescent material which is capable of conducting electric current and which is disposed between a pair of electrodes to which a voltage is to be applied to excite the electroluminescent material to luminescence. Such a display device will hereinafter be referred to as "a display device of the kind specified."

With such display devices it is often required to provide a display having a plurality of discrete light-emitting regions spaced from one another. In one known arrangement this has been achieved by forming a generally continuous layer of the electroluminescent material, and providing, on the side of that layer from which the display is to be viewed, a mask having apertures defining the said display regions, and/or forming lines of cut in the layer of electroluminescent material bounding the display regions. Conveniently these lines of cut have been formed with a scribing instrument.

The electroluminescent material is relatively expensive and in view of this it has further been proposed that the electroluminescent material be disposed only in those regions of the device that are to emit light so as to reduce considerably the amount of electroluminescent material used in the display devices and thereby reduce the cost of the display devices. However, it has been found that it may be difficult and thus time consuming accurately to form the regions of electroluminescent material.

Accordingly it is an object of the present invention to provide an improved method of forming the region or regions of electroluminescent material.

According to one aspect of the present invention there is provided a method of manufacturing a display device of the kind specified, wherein the method comprises the steps of disposing, on an assembly having a substrate with one of said electrodes formed thereon, masking means in which is formed an aperture defining a region in which is to be provided electroluminescent material that is capable of conducting electric current, disposing the electroluminescent material in the said aperture, forming the other of the said electrodes on the exposed surface of the electroluminescent material when it has solidified, and removing the masking means.

The masking means may be adhesively secured to the said assembly, the adhesive bond between the masking means and the assembly being such as to permit the masking means to be readily removed from the assembly.

The said aperture may be substantially filled with the electroluminescent material.

The method may include the step of removing any excess electroluminescent material so that the exposed surfaces of that material and the masking means are flush with one another.

The electroluminescent material may be allowed to dry or cure before removing the masking means.

The electroluminescent material may be mixed with a binder.

The method may include the step of forming the said aperture in the masking means.

The method may include the step of forming the said assembly.

The method may include the steps of disposing first and second masks on the said assembly with the masks overlying one another, the first mask being disposed nearest to the said assembly and having formed therein an aperture in which the electroluminescent material is to be disposed and a slot extending therefrom, and the second mask having an aperture therein aligned with the said aperture in the first mask, disposing the said electroluminescent material in the said aligned apertures, removing the second mask when the electroluminescent material has solidified, forming the said other electrode on the exposed surface of the electroluminescent material and within the slot, and removing the first mask.

According to another aspect of the present invention there is provided a display device of the kind specified manufactured by a method in accordance with the said one aspect of the present invention.

A method of manufacturing a display device in accordance with the present invention will now be described, by way of example, with reference to the accompanying drawings in which.

The display device is a direct current electroluminescent device having two rectangular display regions that are to be illuminated simultaneously. These display regions are of polycrystalline powder phosphor disposed in an organic polymer binder and sandwiched between positive and negative electrodes to which is to be applied a unidirectional voltage for exitation of the phosphor to luminescence. The display device has a single positive electrode common to the display regions while individual negative electrodes are provided for the phosphor layers, the negative electrodes having respective conducting tracks connecting these negative electrodes to a conducting strip which extends along one edge of the display device and which is isolated from the positive electrode.

Figure 1:
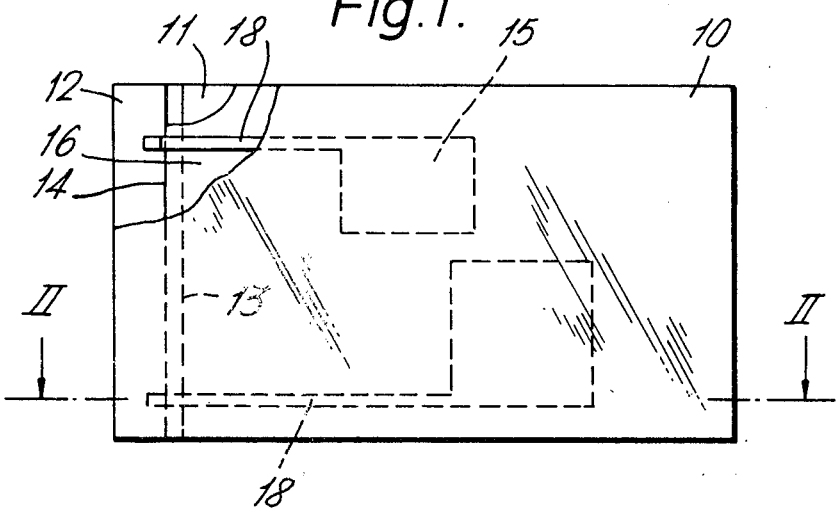
FIG. 1 is a plan view of a display device produced by the said method of manufacture.
Figure 2:
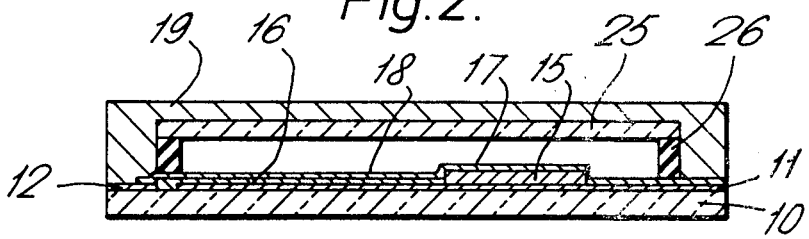
FIG. 2 is a sectional view on the line II—II of FIG. 1.

Referring to FIGS. 1 and 2, the display device includes a rectangular substrate 10 of glass on which is formed by a conventional photo-etching process a transparent, positive electrode 11, and a conducting strip 12 at the left-hand edge of the substrate, to which are to be connected, respectively, the positive and negative terminals of a unidirectional voltage supply. The positive electrode 11 is rectangular and spaced from the conducting strip 12, this space being indicated in FIG. 1 by the dashed lines 13 and 14. The two display regions are defined by respective rectangular sections 15 of the phosphor-binder mixture deposited on the positive electrode 11, and the remainder of the upper surface (FIG. 2) of the positive electrode is coated with a layer 16 of electrically insulating lacquer by means of a conventional silk-screening or photo-resist process. This layer 16 extends into and fills the space between the positive electrode 11 and the conducting strip 12. Individual negative electrodes 17 of aluminium are provided on the upper surfaces of the phosphor display regions 15. These electrodes 17 cover the whole of the upper surfaces of the display regions 15 and have conducting tracks 18 that connect the electrodes 17 to the conducting strip 12. The upper surface of the display device is covered by a sheet 25 of glass that is mounted on two strips 26 of butyl rubber disposed adjacent the edges of the substrate 10, the upper surface of the so-formed assembly then being covered by a layer 19 of a suitable encapsulation material.

When a unidirectional voltage is applied between the positive electrode 11 and the conducting strip 12, the phosphor display regions 15 are excited to luminescence, this light-emission being readily visible through the glass layer 10 and the transparent electrode 11.

Figure 3:
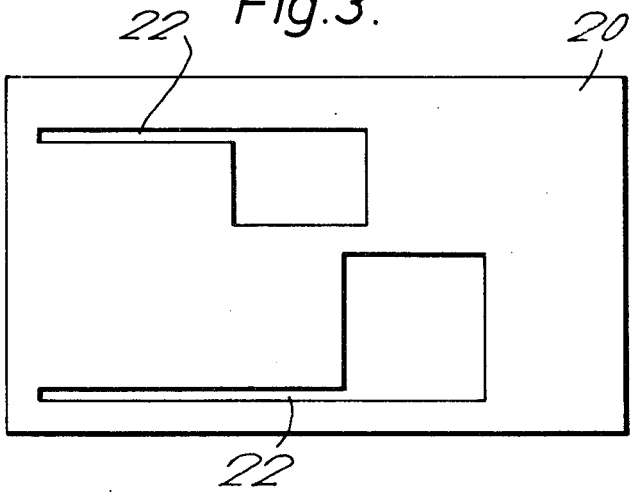
FIGS. 3 and 4 are plan views of masks used in the method of manufacture.
Figure 4:
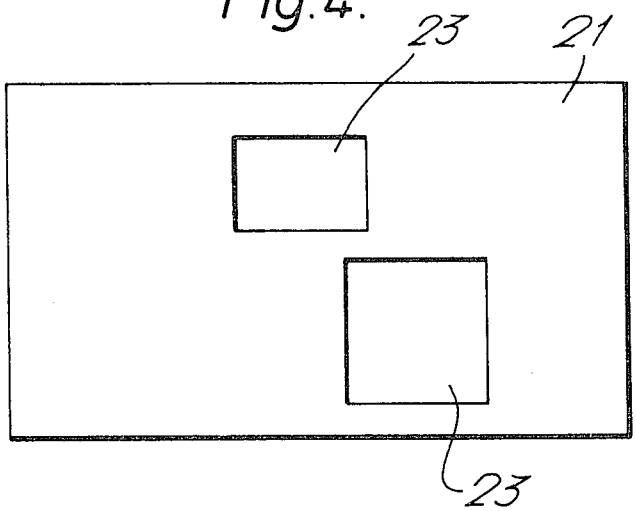

In accordance with the present invention masking means are used in the formation of both the phosphor regions 15 and the negative electrodes 17. This masking means comprises two masks 20 and 21 shown in FIGS. 3 and 4 respectively which are each of rectangular shape and of the same size as the glass substrate 10 of the display device. The mask 20 has apertures 22 therein shaped to correspond to the phosphor regions 15 and the conducting tracks 18 while the mask 21 has apertures 23 therein corresponding only to the phosphor regions 15. These apertures 22 and 23 are formed by stamping.

The masks 20 and 21 may be of any suitable material such as plastics or paper and preferably have a thickness of the order of 50 to 100 microns. The masks 20 and 21 are each coated on their lower surface with adhesive (for example, a low-tack acrylic adhesive) and if desired the adhesive coatings may be covered by removable covering layers (not shown) having high-release surfaces to facilitate their removal. The covering layers are conveniently of paper coated with plastics.

Various materials have been found suitable for forming the masks 20 and 21. For example, these masks may comprise transparent protection masks of plastics supplied by Adhesive Tapes Limited of Elstree Way, Boreham Wood, Hertfordshire and marketed under the trade name Sellotape and the reference Type No. 1421. Alternatively, the masks 20 and 21 may comprise polyvinylchloride tape supplied by Commercial Plastics Limited of Berkeley Square House, London W1and marketed under the trade name Fablon.

Figure 5:
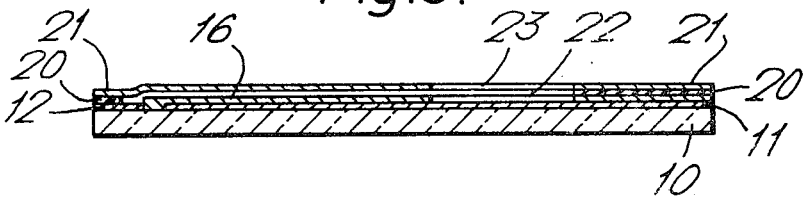
FIGS. 5 to 7 are a series of sectional side views used to explain the method of manufacture.
Figure 6:
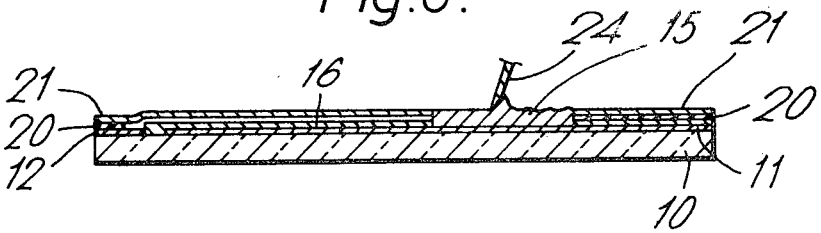
Figure 7:
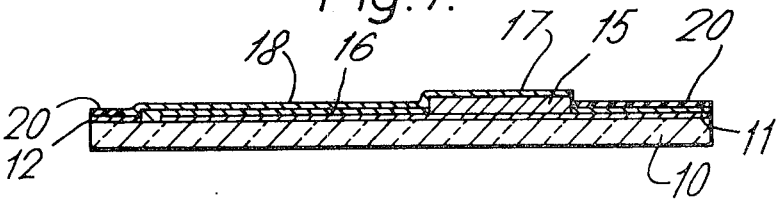

The positive electrode 11, the conducting strip 12 and the layer 16 are first formed on the glass panel 10 as previously described. The masks 20 and 21 are then adhesively secured to the layer 16 as shown in FIG. 5 with the mask 20 disposed beneath the mask 21 and the apertures 22 and 23 aligned with one another and with the rectangular aperture formed in the layer 16. The apertures 23 and the portions of the apertures 22 aligned therewith are then filled with the phosphor-binder mixture to form the display regions 15 (FIG. 6). The mixture is arranged to fill completely the aligned apertures, any excess phosphor mixture being removed by a scraping tool 24 so that the exposed surfaces of the regions of the phosphor mixture are flush with the upper surface of the mask 21. This scraping tool 24 is wide enough to extend completely across the mask 21 so as to permit any excess phosphor mixture in the two regions to be removed in a single operation. When the phosphor mixture has solidified by being cured or allowed to dry, the mask 21 is removed to expose the mask 20 (FIG. 7), and the negative electrodes 17 with their conducting tracks 18 of aluminium are formed by a conventional vacuum-deposition process on the exposed surfaces of the regions 15 and in the elongate slotted-portions of the apertures 22. In an alternative arrangement the negative electrodes 17 and the conducting tracks 18 are formed by a screen printing process.

Although the display device has only two display regions, it is visualised that the display device may have more than two such regions. Also, the display regions need not be excited simultaneously. In such a case, the conducting strip 12 is dispensed with and the conducting tracks 18 are extended to the edge of the panels so as to permit individual connection of the tracks 18 to respective negative terminals of a voltage supply source. Where a multiplicity of display regions are provided it may be required to excite different groups of phosphor regions simultaneously and in these circumstances the conducting tracks 18 may be appropriately connected to one another in the areas of the display device that are not occupied by the phosphor material.

These alternative arrangements of the tracks 18 may readily be provided by appropriately shaping the slotted portions of the apertures 22 in the mask 20.

I claim:

1. A method of manufacturing a display device having a layer of electroluminescent material which is disposed between a pair of electrodes to which a voltage is to be applied to excite the electroluminescent material to luminescence, comprising the steps of disposing on an assembly having a substrate with one of the said electrodes thereon, first and second masks with the masks overlying one another, the first mask being disposed nearest to the said assembly and having formed therein an aperture defining a region in which the said electroluminescent material is to be disposed and a slot extending from that aperture, and the second mask having an aperture therein aligned with the said aperture in the first mask, disposing the said electroluminescent material in the said aligned apertures, removing the said second mask when the electroluminescent material in the said apertures has solidified, forming the said other electrode on the exposed surface of the said electroluminescent material and within the slot, and removing the first mask.

2. A method according to claim 1, wherein said first mask is adhesively secured to said assembly, the adhesive bond between said first mask and the assembly being such as to permit the first mask to be readily removed from the assembly.

3. A method according to claim 1 wherein said second mask is adhesively secured to said first mask, the adhesive bond between said second mask and said first mask being such as to permit said second mask to be readily removed from said first mask.

4. A method according to claim 1, wherein said apertures are substantially filled with the said electroluminescent material.

5. A method according to claim 4, including the step of removing any excess said electroluminescent material so that the exposed surfaces of that material and said second mask are flush with one another.

6. A method according to claim 1, wherein said electroluminescent material is allowed to dry before removing said second mask.

7. A method according to claim 1, wherein said electroluminescent material is cured before removing said second mask.

8. A method of manufacturing a display device having a layer of electroluminescent material which is disposed between a pair of electrodes to which a voltage is to be applied to excite the electroluminescent material to luminescence, comprising the steps of disposing on an assembly having a substrate with one of the said electrodes thereon, first and second masks with the masks overlying one another, the first mask being disposed nearest to the said assembly and having formed therein an aperture defining a region in which the said electroluminescent material is to be disposed and a slot extending from that aperture, and the second mask having an aperture therein aligned with the said aperture in the first mask, said first mask being adhesively secured to said assembly, the adhesive bond between said first mask and said assembly being such as to permit the first mask to be readily removed from the assembly, said second mask being adhesively secured to said first mask, the adhesive bond between said second mask and said first mask being such as to permit said second mask to be readily removed from said first mask, disposing the said electroluminescent material in the said aligned apertures, removing the said second mask when the electroluminescent material in the said apertures has solidified, forming the said other electrode on the exposed surface of the said electroluminescent material and within the slot, and removing the first mask.

* * * * *